US006321757B1

(12) United States Patent
McCutcheon

(10) Patent No.: US 6,321,757 B1
(45) Date of Patent: Nov. 27, 2001

(54) CIGARETTE PACK AND ASH HOLDER/EXTINGUISHER

(76) Inventor: Paul Jerry McCutcheon, 440 Center Rd., Union, SC (US) 29379

( * ) Notice: Subject to any disclaimer, the term of this patent is extended or adjusted under 35 U.S.C. 154(b) by 0 days.

(21) Appl. No.: 09/506,565

(22) Filed: Feb. 18, 2000

(51) Int. Cl.[7] ..... A24F 13/18; A24F 15/00

(52) U.S. Cl. ..... 131/235.1; 131/231; 131/237.5; 131/256; 206/246; 206/265; 206/268; 206/256; 206/267; 206/264

(58) Field of Search ..... 131/231, 235.1, 131/237.5, 256; 206/246, 265, 268, 86, 256, 257, 264; D27/106, 102, 103, 129, 136

(56) References Cited

U.S. PATENT DOCUMENTS

| | | | | |
|---|---|---|---|---|
| Re. 31,076 | * | 11/1982 | Herman | 206/246 |
| D. 309,033 | | 7/1990 | Mohr . | |
| 2,764,984 | * | 10/1956 | Cohen et al. | 131/235.1 |
| 2,777,569 | | 1/1957 | Starke, Jr. . | |
| 2,944,555 | | 7/1960 | Peel et al. . | |
| 3,888,264 | * | 6/1975 | Baclit | 131/235.1 |
| 4,252,237 | * | 2/1981 | Baclit | 206/86 |
| 4,789,059 | | 12/1988 | Kim . | |
| 5,520,196 | | 5/1996 | Yang . | |
| 5,682,986 | | 11/1997 | Cobler . | |

* cited by examiner

*Primary Examiner*—Stanley S. Silverman
*Assistant Examiner*—Dionne A. Walls

(57) ABSTRACT

A cigarette pack and ash holder/extinguisher for neatly keeping cigarettes and their ashes in a container. The cigarette pack and ash holder/extinguisher includes a container having a plurality of compartments with a first one of which being adapted to receive and store a pack of cigarettes and with a second one of which being adapted to receive and store cigarette ashes and spent cigarettes; and also includes a tubular member being securely disposed in the second one of the compartments and being adapted to extinguish a cigarette; and further includes a first and second lid members hingedly attached to the container; and also includes a pair of latch members securely attached to the lid members and a pair of boss members securely attached to the container for fastening the lid members to the container; and further includes a clip member securely attached to the container for clipping onto an object.

8 Claims, 2 Drawing Sheets

CIGARETTE PACK AND ASH HOLDER/EXTINGUISHER

BACKGROUND OF THE INVENTION

1. Field of the Invention

The present invention relates to a container for cigarettes and for ashes and spent cigarettes and more particularly pertains to a new cigarette pack and ash holder/extinguisher for neatly keeping cigarettes and their ashes in a container.

2. Description of the Prior Art

The use of a container for cigarettes and for ashes and spent cigarettes is known in the prior art. More specifically, a container for cigarettes and for ashes and spent cigarettes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,520,196; U.S. Pat. No. 2,944,555; U.S. Pat. No. 5,682,986; U.S. Pat. No. Des. 309,033; U.S. Pat. No. 4,789,059; and U.S. Pat. No. 2,777,569.

While these devices fulfill their respective, particular objectives and requirements, the aforementioned patents do not disclose a new cigarette pack and ash holder/extinguisher. The inventive device includes a container having a plurality of compartments with a first one of which being adapted to receive and store a pack of cigarettes and with a second one of which being adapted to receive and store cigarette ashes and spent cigarettes; and also includes a tubular member being securely disposed in the second one of the compartments and being adapted to. extinguish a cigarette; and further includes a first and second lid members hingedly attached to the container; and also includes a pair of latch members securely attached to the lid members and a pair of boss members securely attached to the container for fastening the lid members to the container; and further includes a clip member securely attached to the container for clipping onto an object.

In these respects, the cigarette pack and ash holder/extinguisher according to the present invention substantially departs from the conventional concepts and designs of the prior art, and in so doing provides an apparatus primarily developed for the purpose of neatly keeping cigarettes and their ashes in a container.

SUMMARY OF THE INVENTION

In view of the foregoing disadvantages inherent in the known types of container for cigarettes and for ashes and spent cigarettes now present in the prior art, the present invention provides a new cigarette pack and ash holder/extinguisher construction wherein the same can be utilized for neatly keeping cigarettes and their ashes in a container.

The general purpose of the present invention, which will be described subsequently in greater detail, is to provide a new cigarette pack and ash holder/extinguisher which has many of the advantages of the container for cigarettes and for ashes and spent cigarettes mentioned heretofore and many novel features that result in a new cigarette pack and ash holder/extinguisher which is not anticipated, rendered obvious, suggested, or even implied by any of the prior art container for cigarettes and for ashes and spent cigarettes, either alone or in any combination thereof.

To attain this, the present invention generally comprises a container having a plurality of compartments with a first one of which being adapted to receive and store a pack of cigarettes and with a second one of which being adapted to receive and store cigarette ashes and spent cigarettes; and also includes a tubular member being securely disposed in the second one of the compartments and being adapted to extinguish a cigarette; and further includes a first and second lid members hingedly attached to the container; and also includes a pair of latch members securely attached to the lid members and a pair of boss members securely attached to the container for fastening the lid members to the container; and further includes a clip member securely attached to the container for clipping onto an object.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cigarette pack and ash holder/extinguisher apparatus and method which has many of the advantages of the container for cigarettes and for ashes and spent cigarettes mentioned heretofore and many novel features that result in a new cigarette pack and ash holder/extinguisher which is not anticipated, rendered obvious, suggested, or even implied by any of the prior art container for cigarettes and for ashes and spent cigarettes, either alone or in any combination thereof.

It is another object of the present invention to provide a new cigarette pack and ash holder/extinguisher which may be easily and efficiently manufactured and marketed.

It is a further object of the present invention to provide a new cigarette pack and ash holder/extinguisher which is of a durable and reliable construction.

An even further object of the present invention is to provide a new cigarette pack and ash holder/extinguisher which is susceptible of a low cost of manufacture with regard to both materials and labor, and which accordingly is then susceptible of low prices of sale to the consuming public, thereby making such cigarette pack and ash holder/extinguisher economically available to the buying public.

Still yet another object of the present invention is to provide a new cigarette pack and ash holder/extinguisher which provides in the apparatuses and methods of the prior art some of the advantages thereof, while simultaneously overcoming some of the disadvantages normally associated therewith.

Still another object of the present invention is to provide a new cigarette pack and ash holder/extinguisher for neatly keeping cigarettes and their ashes in a container.

Yet another object of the present invention is to provide a new cigarette pack and ash holder/extinguisher which includes a container having a plurality of compartments with a first one of which being adapted to receive and store a pack of cigarettes and with a second one of which being adapted to receive and store cigarette ashes and spent cigarettes; and also includes a tubular member being securely disposed in the second one of the compartments and being adapted to extinguish a cigarette; and further includes a first and second lid members hingedly attached to the container; and also includes a pair of latch members securely attached to the lid members and a pair of boss members securely attached to the container for fastening the lid members to the container; and further includes a clip member securely attached to the container for clipping onto an object.

Still yet another object of the present invention is to provide a new cigarette pack and ash holder/extinguisher that reduces the mess associated with a person smoking cigarettes Even still another object of the present invention is to provide a new cigarette pack and ash holder/extinguisher that is easy and convenient to use so that ashes don't get all over the place.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
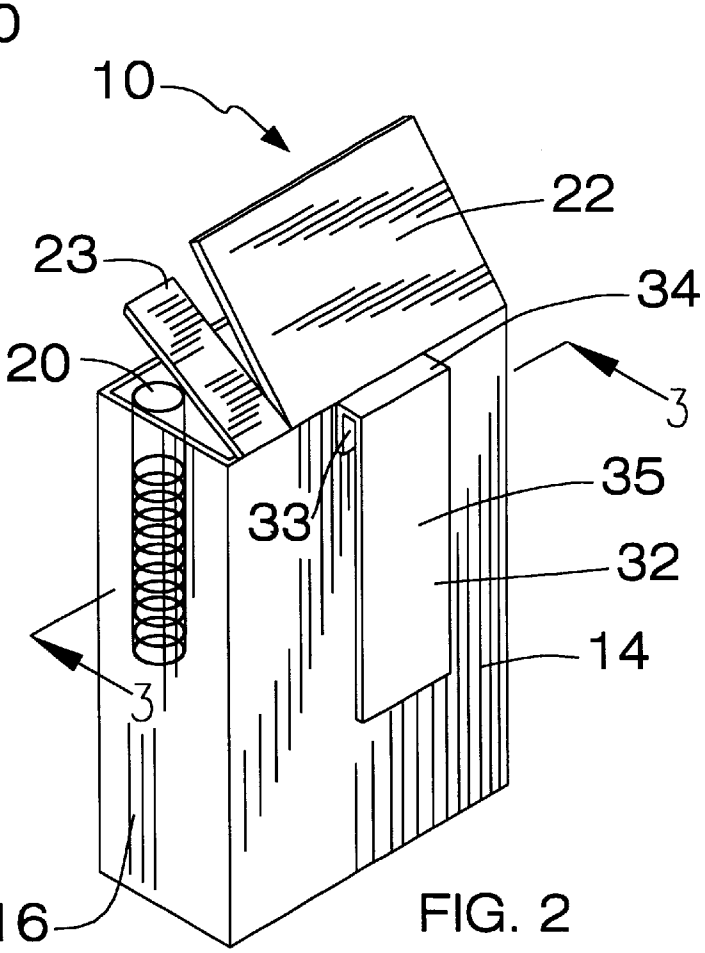
FIG. 2 is a rear perspective view of the present invention.
Figure 1:
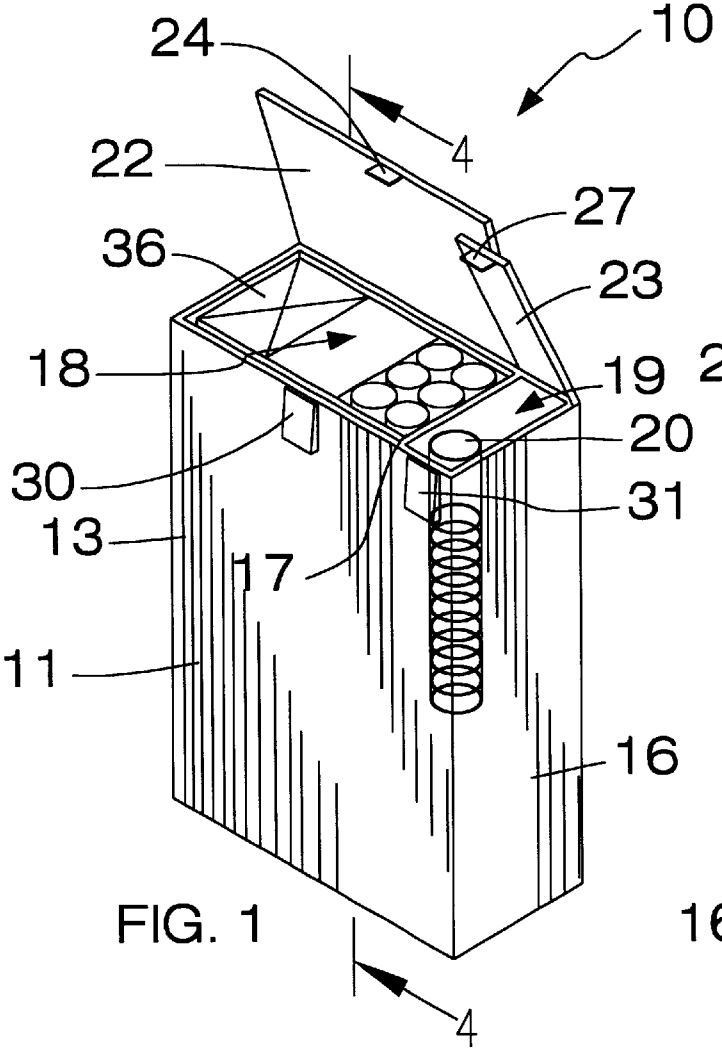
FIG. 1 is a front perspective view of a new cigarette pack and ash holder/extinguisher according to the present invention.
Figures 3, 4:
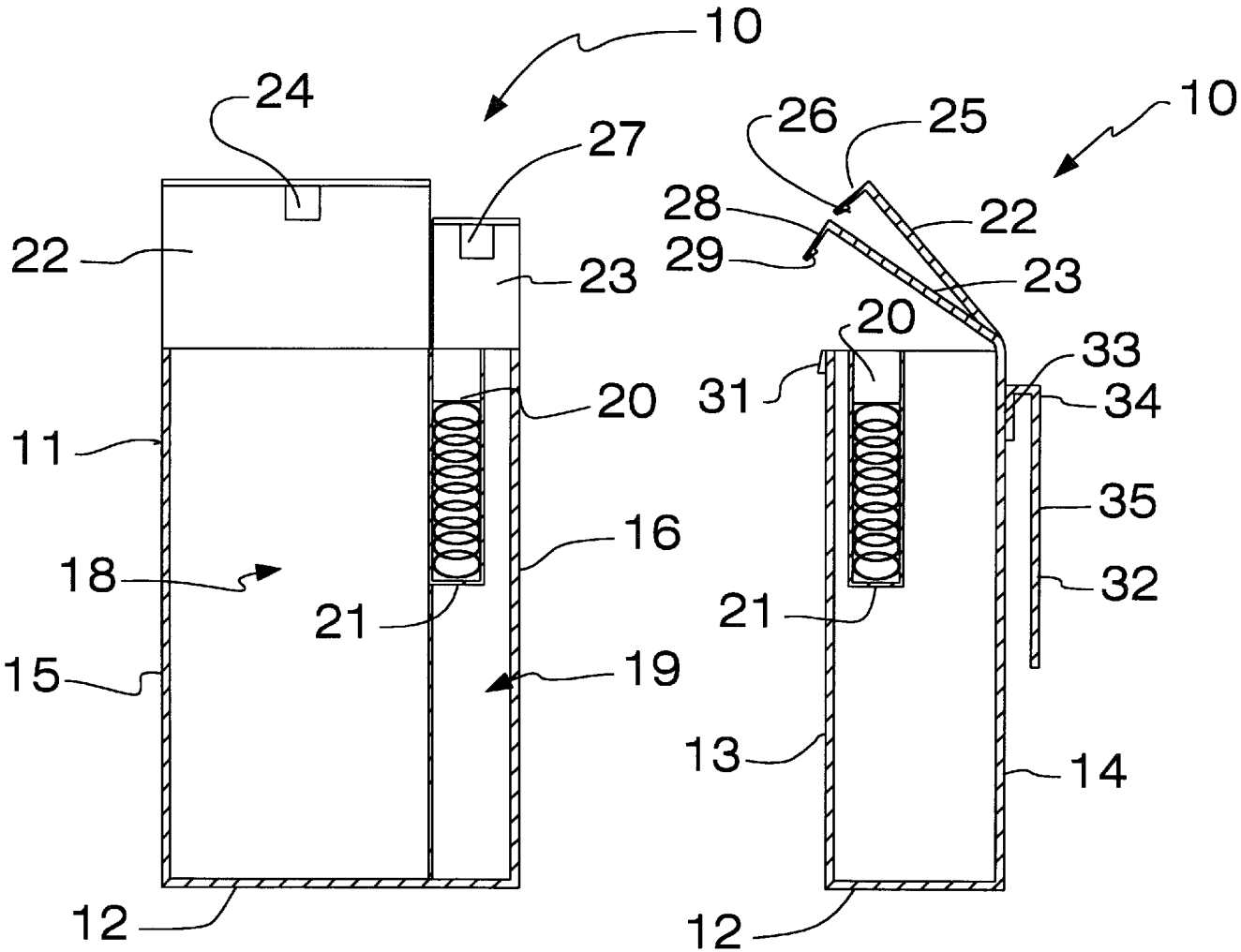
FIG. 3 is a front cross-sectional view of the present invention.
FIG. 4 is a side cross-sectional view of the present invention.

With reference now to the drawings, and in particular to FIGS. 1 through 4 thereof, a new cigarette pack and ash holder/extinguisher embodying the principles and concepts of the present invention and generally designated by the reference numeral 10 will be described.

As best illustrated in FIGS. 1 through 4, the cigarette pack and ash holder/extinguisher 10 generally comprises a container 11 having side walls 15,16, a front wall 13, a back wall 14, a bottom wall 12, an open top, and an internal cavity 18,19. The container 11 further has one partition 17 securely and conventionally disposed in the internal cavity 18,19 and separating the internal cavity 18,19 into a plurality of compartments. A first one 18 of the compartments is adapted to store a pack of cigarettes 36, and a second one 19 of the compartments is adapted to store ashes and spent cigarettes. The container 11 is essentially rectangular.

A first lid member 22 has a back end which is hingedly and conventionally attached to a top of the back wall 14 and is closeable over the first one 18 of the compartments. A second lid member 23 has a back end which is hingedly and conventionally attached to a top of the back wall 14 and is closeable over the second one 19 of the compartments. A tubular member 20 is securely and conventionally disposed in the second one 19 of the compartments and is adapted to receive a burning portion of a cigarette for extinguishing the cigarette. The tubular member 20 has a bottom end 21 which is spaced above the bottom wall 12 of the container 11. The tubular member 20 is securely and conventionally attached to an interior of the front wall 13 of the container 11. A means for fastening the first and second lid members to the container 11 includes a first 30 and second 31 boss members securely and conventionally attached to an exterior of the front wall 13 near a top thereof, and also includes a first latch member 24 securely and integrally attached to a front end of the first lid member 22 and extending perpendicularly therefrom and being in alignment with the first boss member 30, and further includes a second latch member 27 securely attached to a front end of the second lid member 23 and extending perpendicularly therefrom and being in alignment with the second boss member 31. Each of the first and second latch members 24,27 includes an extended portion 25,28 having a back side, and also includes a flange portion 26,29 securely and integrally attached at an end of the back side of the extended portion 25,28. The flange portion 26,29 is adapted to engage a bottom end of a respective one of the boss members 30,31. A clip member 32 is securely and conventionally attached to an exterior of the back wall 14 for clipping the container 11 to an object such as a belt or shirt pocket. The clip member 32 includes a first portion 33 which is securely and conventionally attached to the exterior of the back wall 14 of the container 11, and also includes an intermediate portion 34 which is integrally attached to the first portion 33 and extends outwardly and perpendicularly from the back wall 14, and further includes a second portion 35 which is integrally attached to an end of the intermediate portion 34 and which extends parallel to the back wall 14 with the second portion 35 being spaced from the back wall 14 and from the first portion 33 to allow an object to be received therebetween.

In use, the user can insert a pack of cigarettes 36 in the first one 18 of the compartments, and as the user smokes, and uses a cigarette, the user can extinguish the cigarette by putting the burning end of the cigarette into the tubular member 20 which snuffs out the cigarette, and then once the cigarette is put out, the use can throw the spent cigarette into the second one 19 of the compartments. Also, while the user is smoking the cigarette, the user can put the ashes into the second one 19 of the compartments.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cigarette pack and ash holder/extinguisher comprising:

a container having a pair of side walls, a front wall, a back wall, a bottom wall, an open top, and an internal cavity, said container further having at least one partition securely disposed in said internal cavity such that said partition forms a third said side wall having dimensions substantially the same as said pair of side walls, and separating said internal cavity into a plurality of compartments sharing said third side wall, a first one of said compartments being adapted for storing a pack of cigarettes, and a second one of said compartments being adapted for storing ashes and spent cigarettes, said front wall and back walls each having a greater width than a width of each of said side walls;

a first lid member having a back end which is hingedly attached to a top of said back wall and being closeable over said first one of said compartments;

a second lid member having a back end which is hingedly attached to a top of said back wall and being closeable over said second one of said compartments;

a tubular member securely disposed in said second one of said compartments and being adapted to receive a burning portion of a cigarette for extinguishing the cigarette;

a means for fastening said first and second lid members to said container; and a clip member securely attached to an exterior of said back wall for clipping said container to an object.

2. A cigarette pack and ash holder/extinguisher as described in claim 1, wherein said tubular member has a bottom end which is spaced above said bottom wall of said container.

3. A cigarette pack and ash holder/extinguisher as described in claim 1, wherein said tubular member is securely attached to an interior of said front wall of said container.

4. A cigarette pack and ash holder/extinguisher as described in claim 1, wherein said means for fastening said first and second lid members to said container includes a first and second boss members securely attached to an exterior of said front wall near a top thereof, and also includes a first latch member securely attached to a front end of said first lid member and extending perpendicularly therefrom and being in alignment with said first boss member, and further includes a second latch member securely attached to a front end of said second lid member and extending perpendicularly therefrom and being in alignment with said second boss member.

5. A cigarette pack and ash holder/extinguisher as described in claim 4, wherein each of said first and second latch members includes an extended portion having a back side, and also includes a flange portion securely attached at an end of said back side of said extended portion, said flange portion being adapted to engage a bottom end of a respective one of said boss members.

6. A cigarette pack and ash holder/extinguisher as described in claim 1, wherein said clip member includes a first portion which is securely attached to said exterior of said back wall of said container, and also includes an intermediate portion which is integrally attached to said first portion and extends outwardly and perpendicularly from said back wall, and further includes a second portion which is integrally attached to an end of said intermediate portion and which extends parallel to said back wall, said second portion being spaced from said back wall and from said first portion to allow an object to be received therebetween.

7. A cigarette pack and ash holder/extinguisher comprising:

a container having a pair of side walls, a front wall, a back wall, a bottom wall, an open top, and an internal cavity, said container further having at least one partition securely disposed in said internal cavity such that said partition forms a third said side wall having dimensions substantially the same as said pair of said side walls and separates said internal cavity into a plurality of compartments, a first one of said compartments being adapted for storing a pack of cigarettes, and a second one of said compartments being adapted for storing ashes and spent cigarettes, said container being essentially rectangular, said front and back walls each having a greater width than a width of each of said side walls;

a first lid member having a back end which is hingedly attached to a top of said back wall and being closeable over said first one of said compartments;

a second lid member having a back end which is hingedly attached to a top of said back wall and being closeable over said second one of said compartments;

a tubular member securely disposed in said second one of said compartments and being adapted to receive a burning portion of a cigarette for extinguishing the cigarette, said tubular member having a bottom end which is spaced above said bottom wall of said container, said tubular member being securely attached to an interior of said front wall of said container;

a means for fastening said first and second lid members to said container including a first and second boss members securely attached to an exterior of said front wall near a top thereof, and also including a first latch member securely attached to a front end of said first lid member and extending perpendicularly therefrom and being in alignment with said first boss member, and further including a second latch member securely attached to a front end of said second lid member and extending perpendicularly therefrom and being in alignment with said second boss member, each of said first and second latch members including an extended portion having a back side, and also including a flange portion securely attached at an end of said back side of said extended portion, said flange portion being adapted to engage a bottom end of a respective one of said boss members; and a clip member securely attached to an exterior of said back wall for clipping said container to an object, said clip member including a first portion which is securely attached to said exterior of said back wall of said container, and also including an intermediate portion which is integrally attached to said first portion and extends outwardly and perpendicularly from said back wall, and further including a second portion which is integrally attached to an end of said intermediate portion and which extends parallel to said back wall, said second portion being spaced from said back wall and from said first portion to allow an object to be received therebetween.

8. The cigarette pack and ash holder/extinguisher of claim 1, wherein said first one of said compartments and said second one of said compartments each have a width substantially equal to the width of each of said side walls.

* * * * *